US010989198B1

(12) United States Patent
Lin

(10) Patent No.: US 10,989,198 B1
(45) Date of Patent: Apr. 27, 2021

(54) DETACHABLE SUBMERSIBLE PUMP WITH MODULAR DESIGN

(71) Applicant: FUJIAN AIDI ELECTRIC CO., LTD., Longyan (CN)

(72) Inventor: Xi Zhen Lin, Xiamen (CN)

(73) Assignee: FUJIAN AIDI ELECTRIC CO., LTD., Longyan (CN)

( * ) Notice: Subject to any disclaimer, the term of this patent is extended or adjusted under 35 U.S.C. 154(b) by 0 days.

(21) Appl. No.: 17/006,909

(22) Filed: Aug. 31, 2020

(30) Foreign Application Priority Data

Jul. 24, 2020 (CN) ..... 202010723157.2

(51) Int. Cl.

| | |
|---|---|
| ***F04D 13/08*** | (2006.01) |
| ***F04D 29/40*** | (2006.01) |
| ***F04D 29/06*** | (2006.01) |
| ***F04D 29/08*** | (2006.01) |

(52) U.S. Cl.
CPC ..... *F04D 13/086* (2013.01); *F04D 29/061* (2013.01); *F04D 29/086* (2013.01); *F04D 29/406* (2013.01)

(58) Field of Classification Search
CPC ..... F04D 13/02; F04D 13/06; F04D 13/08; F04D 29/406; F04D 29/42; F04D 29/426; F04D 29/60; F04D 29/605; F04D 29/628
USPC ..... 417/423.3, 423.14
See application file for complete search history.

(56) References Cited

U.S. PATENT DOCUMENTS

| | | | | |
|---|---|---|---|---|
| 4,218,195 | A * | 8/1980 | Shure | F04D 13/086 417/411 |
| 4,950,133 | A * | 8/1990 | Sargent | F04D 29/664 4/541.5 |
| 6,276,908 | B1 * | 8/2001 | Batchelder | F04D 13/06 417/360 |
| 6,481,973 | B1 * | 11/2002 | Struthers | F04D 7/045 417/36 |
| 7,748,965 | B2 * | 7/2010 | Schopperle | F04D 29/605 417/423.3 |
| 7,806,664 | B2 * | 10/2010 | Patel | F04D 29/628 417/40 |
| 10,302,090 | B2 * | 5/2019 | Moormann | F04D 29/4293 |
| 2007/0086888 | A1 * | 4/2007 | Patel | F04D 29/588 415/177 |

FOREIGN PATENT DOCUMENTS

| | | | | |
|---|---|---|---|---|
| DE | 4402718 | A1 * | 9/1994 | F04D 13/021 |

* cited by examiner

*Primary Examiner* — Charles G Freay
*Assistant Examiner* — Chirag Jariwala
(74) *Attorney, Agent, or Firm* — Bayramoglu Law Offices LLC

(57) ABSTRACT

A detachable submersible pump with a modular design includes a motor module and a pump chamber module. The motor module includes an upper cover, a motor, a motor cover, and an impeller. The pump chamber module includes a housing, a water outlet, a connecting pipe, and a lock nut. The water outlet is arranged on one side of the housing. The lock nut is sleeved on the connecting pipe and is connected to the water outlet by threads. Each of two sides of the upper cover is provided with a pressable elastic buckle. Each of two sides of the housing is provided with a clamping hole. The impeller is placed inside the housing.

9 Claims, 12 Drawing Sheets

DETACHABLE SUBMERSIBLE PUMP WITH MODULAR DESIGN

CROSS REFERENCE TO THE RELATED APPLICATIONS

This application is based upon and claims priority to Chinese Patent Application No. 202010723157.2, filed on Jul. 24, 2020, the entire contents of which are incorporated herein by reference.

TECHNICAL FIELD

The present invention relates to a submersible pump, and more particularly, to a detachable submersible pump with a modular design.

BACKGROUND

A submersible pump is a versatile tool for water treatment and differs from an ordinary pump in that the submersible pumps are designed for use underwater. The submersible pump generally includes a pump body, a motor and an impeller. The pump body is provided with a water inlet and a water outlet. The motor is activated to drive the impeller to rotate so that water is driven into the body of the pump via the water inlet, and then discharged via the water outlet. The hollow part inside the pump body forms a water flow channel. Before activating the pump, the suction pipe and pump must be filled with fluid. After activating the pump, the impeller rotates at a high speed. The fluid therein rotates with the blades and is separated from the impeller under the centrifugal action and ejected outwards. The ejected fluid in the diffusion chamber of the pump casing gradually slows down with increasing pressure, and then flows out of the outlet and discharge pipe of the pump. A vacuum low-pressure zone with neither air nor fluid is formed at the center of the blades since the fluid is thrown around. The fluid in the liquid pool flows into the pump through the suction pipe under the action of the atmospheric pressure of the pool surface. In such a way, the fluid is continuously pumped from the liquid pool and then continuously flows out of the discharge pipe.

In a majority of submersible pumps, however, the casing and the upper cover are integrally formed into a single unit by ultrasonic welding, which is not conducive to regular cleaning and maintenance. Moreover, it is normally not practical to repair the motor that has burned out and thus the motor has to be scrapped, which increases the running cost. It is, therefore, highly desirable to provide a new detachable submersible pump.

SUMMARY

(1) Technical Problems to be Solved

An objective of the present invention is to provide a detachable submersible pump with a modular design. This submersible pump is designed modularly to facilitate disassembly, cleaning and replacement of accessories. In order to achieve the above-mentioned objective, the present invention adopts the following technical solution.

(2) Technical Solution

A detachable submersible pump with a modular design includes a motor module and a pump chamber module. The motor module includes an upper cover, a motor, a motor cover, and an impeller. The motor is placed inside the upper cover and the motor cover. The output shaft of the motor passes through the motor cover and is connected to the impeller.

The pump chamber module includes a housing, a water outlet, a connecting pipe, and a lock nut. The water outlet is arranged on one side of the housing. The lock nut is sleeved on the connecting pipe and is connected to the water outlet by threads.

Each of the two sides of the upper cover is provided with a pressable elastic buckle. Each of the two sides of the housing is provided with a clamping hole. The buckle is engaged with the clamping hole to fixedly connect the motor module and the pump chamber module, and the impeller is placed inside the housing.

Further, the bottom of the housing is connected to a filter cover through another two clamping holes, wherein the filter cover is provided with two elastic buckles.

Further, the bottom of the pump chamber module is rotatably connected to a three-way pipe.

Further, the bottom of the housing is provided with a plurality of clamping blocks distributed annularly. The inner side of the top of the three-way pipe is provided with limiting blocks distributed annularly. The plurality of clamping blocks are in an interference fit with the limiting blocks. The housing and the three-way pipe can rotate 360° relative to each other.

Further, a check valve is provided inside the connecting pipe.

Further, a printed circuit board (PCB) is provided inside the motor module.

Further, the PCB is fixed on the end surface of the motor through a PCB bracket.

Further, an oil seal seat is sleeved on the output shaft of the motor, and a plurality of oil seals are provided between the oil seal seat and the motor cover.

Further, the upper cover and the motor cover are welded in a double ultrasonic wire structure.

(3) Advantages

Compared with the prior art, the present invention has significant advantages specifically as follows.

1. The submersible pump is modularly designed. The circuit module is separate from the water passage, and the modules are detachably connected to facilitate disassembly, cleaning and replacement of accessories.

2. The quick connector makes the pump able to be quickly disassembled without removing the water pipe, which makes the new pump more convenient to use.

3. The entire motor assembly is sealed by the double ultrasonic wire structure design of the upper cover, the motor cover and the sealing mechanism, including the oil seal and sealing ring of the motor module. This provides improved waterproof and sealing protection for electrical components.

4. The traditional relay is replaced with the PCB to realize the on-off function, whereby the running time of the water pump is controlled to improve the safety and reliability, increasing the service life of the motor.

BRIEF DESCRIPTION OF THE DRAWINGS

The present invention will be further described below with reference to the drawings and embodiments.

DESCRIPTION OF THE REFERENCE NUMERALS

Figure 1:
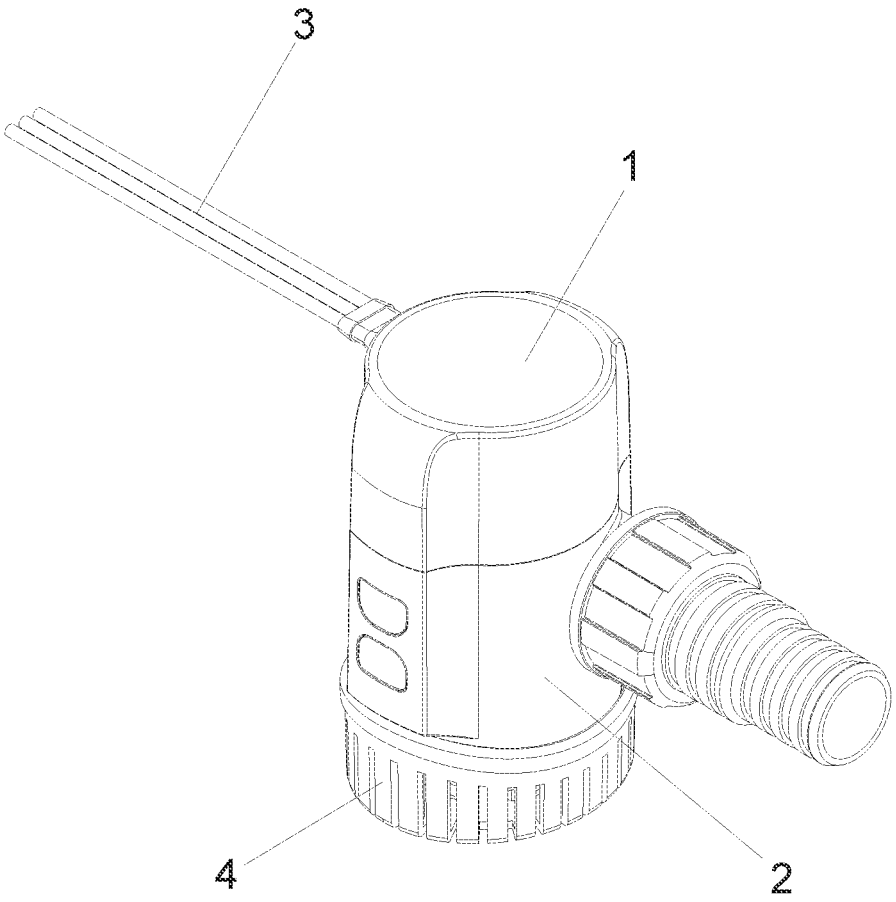
FIG. 1 is a schematic diagram showing the overall structure of Embodiment 1.
Figure 2:
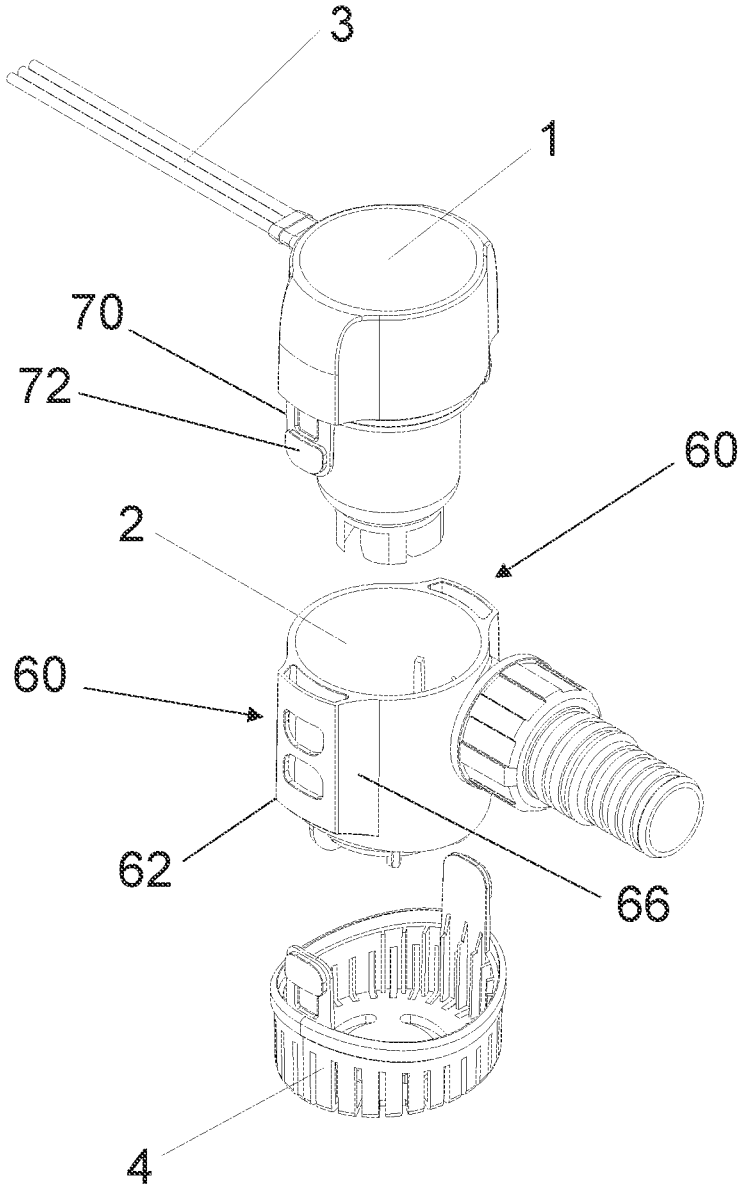
FIG. 2 is a schematic diagram showing a disassembled state of the modules of Embodiment 1.
Figure 3:
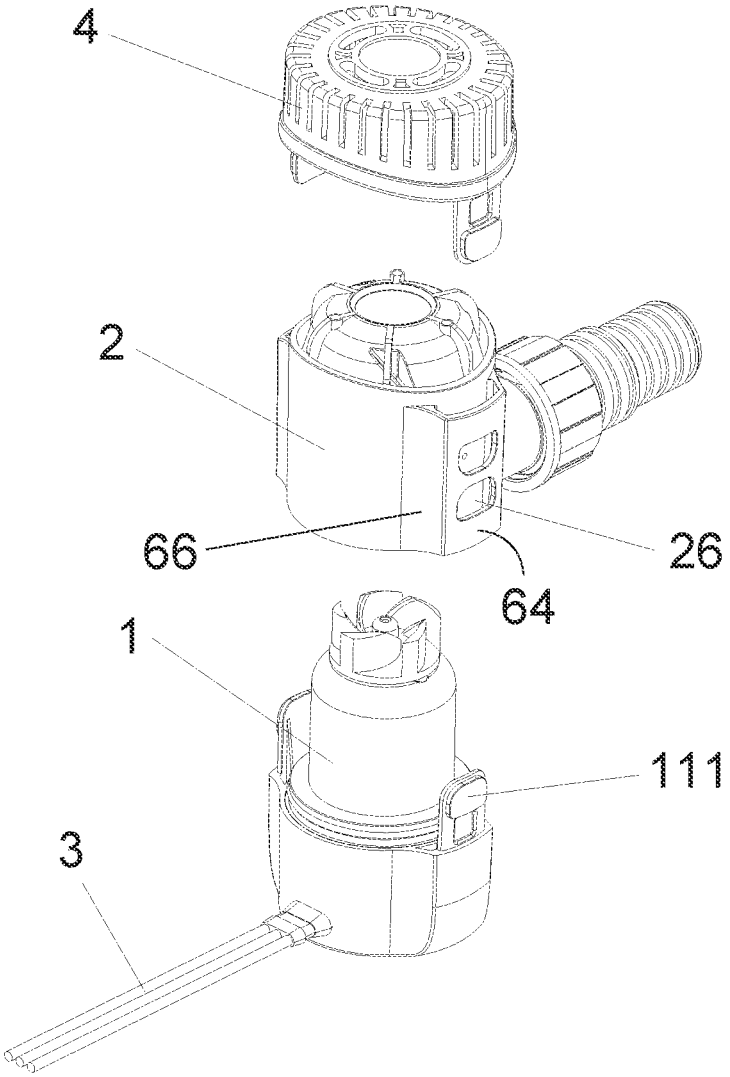
FIG. 3 is a schematic diagram showing the disassembled state of the modules of Embodiment 1 from another angle of view.
Figure 4:
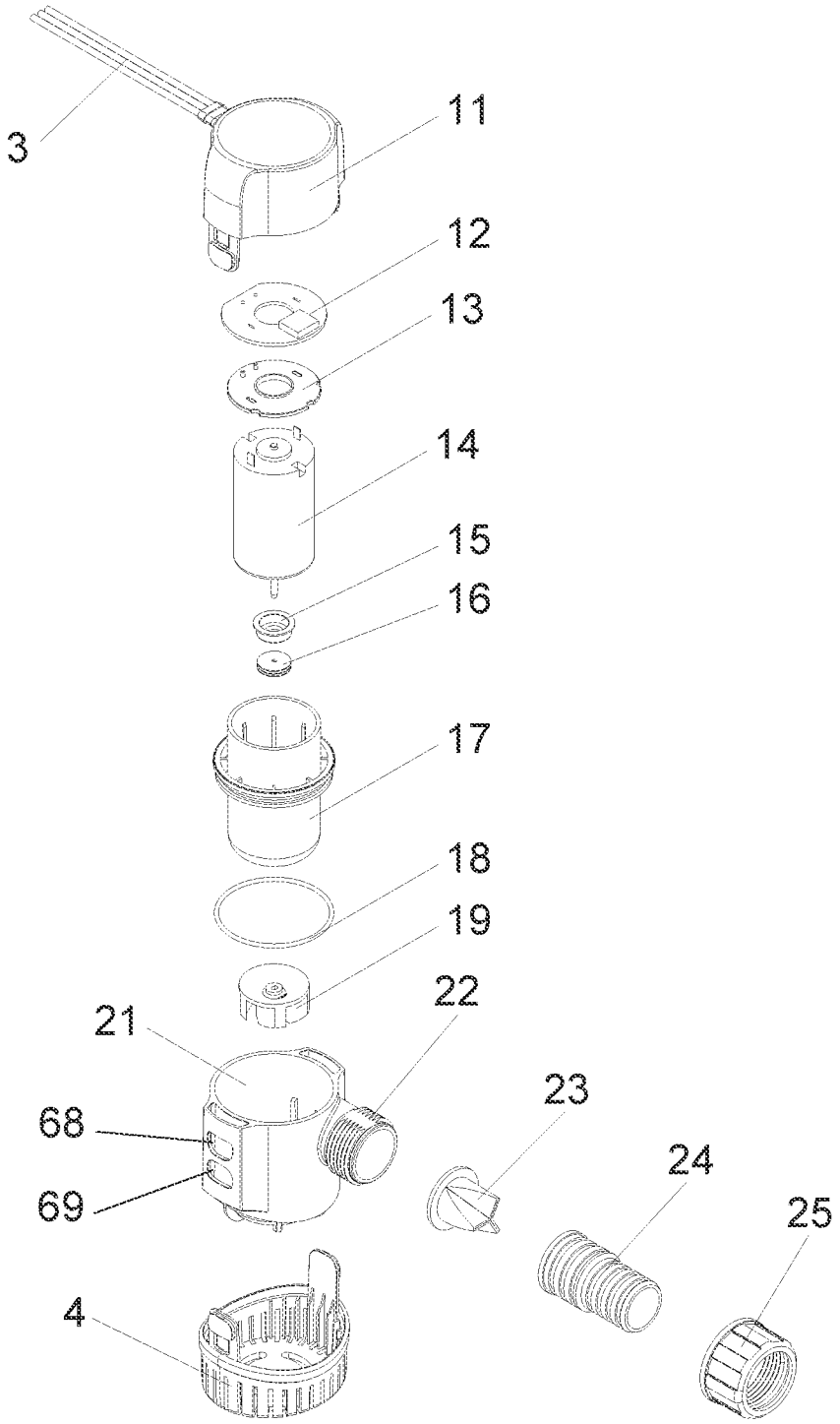
FIG. 4 is an exploded view of Embodiment 1.

1, motor module; 11, upper cover; 111, buckle; 12, PCB; 13, PCB bracket; 14, motor; 15, oil seal seat; 16, oil seal; 17, motor cover; 18, sealing ring; 19, impeller; 2, pump chamber module; 21, housing; 22, water outlet; 23, check valve; 24, connecting pipe; 25, lock nut; 26, clamping hole; 27, clamping block; 3, power cord; 4, filter cover; 5, three-way pipe; 51, limiting block; 60, outwardly extending clamping hole structure; 62, channel body; 64, planer surface; 66, side wall; 68, first clamping hole; 70, elastic buckle; 72, enlarged head; and 69, second clamping hole.

DETAILED DESCRIPTION OF THE EMBODIMENTS

The embodiments of the present invention will be described in detail hereinafter. The illustrative embodiments are shown in the drawings, wherein the same or similar reference numerals denote the same or similar elements or elements with the same or similar functions throughout. The embodiments described below with reference to the drawings are exemplary, and are intended to explain the present invention, but should not be construed as limiting the present invention.

In the description of the present invention, it should be understood that the terminologies such as "length", "width", "upper", "lower", "front", "rear", "left", "right", "vertical", "horizontal", "top", "bottom" "inner" and "outer" indicating an orientation or positional relationship are based on the orientation or positional relationship shown in the drawings, and only used to facilitate describing the present invention and simplifying the description rather than indicating or implying that the indicated device or element must have a specific orientation, be constructed and operated in a specific orientation, and therefore cannot be construed as a limitation of the present invention.

In addition, the terminologies "first" and "second" are only used for descriptive purposes, and cannot be construed as indicating or implying relative importance or implicitly indicating the number of indicated technical features. Thus, the features defined by "first" and "second" may explicitly or implicitly include one or more of these features. In the description of the present invention, "plurality" means two or more, unless otherwise specifically defined.

Unless otherwise clearly specified and defined, the terminologies "install", "connect to", "connect", "fix" and the like should be interpreted broadly. For example, it can be a fixed connection, a detachable connection, or integrally formed; it can be a mechanical connection or an electrical connection. Alternatively, it can be a direct or indirect connection through an intermediate medium, and it can be an internal communication between two elements or an interaction between two elements. For those having ordinary skill in the art, the specific meanings of the above terminologies in the present invention can be understood according to specific circumstances.

The present invention will be further described below with reference to the drawings and specific embodiments.

Referring to FIGS. 1-4, a detachable submersible pump with a modular design includes the motor module 1 and the pump chamber module 2. The top of the motor module 1 is connected to the power cord 3.

The motor module 1 includes the upper cover 11, the motor 14, the motor cover 17, and the impeller 19. The motor 14 is placed inside the upper cover 11 and the motor cover 17. The output shaft of the motor 14 passes through the motor cover 17 and is connected to the impeller 19.

The pump chamber module 2 includes the housing 21, the water outlet 22, the connecting pipe 24, and the lock nut 25. The water outlet 22 is provided on one side of the housing 21. The lock nut 25 is sleeved on the connecting pipe 24 and is connected to the water outlet 22 by threads.

Each of the two sides of the upper cover 11 is provided with the pressable elastic buckle 111. Each of the two sides of the housing 21 is provided with the clamping hole 26. The buckle 111 is engaged with the clamping hole 26 to fixedly connect the motor module 1 and the pump chamber module 2, and the impeller 19 is placed inside the housing 21.

The check valve 23 is provided inside the connecting pipe 24 to prevent the fluid in the pipeline from flowing back into the pump chamber after the water pump is stopped.

Figure 5:
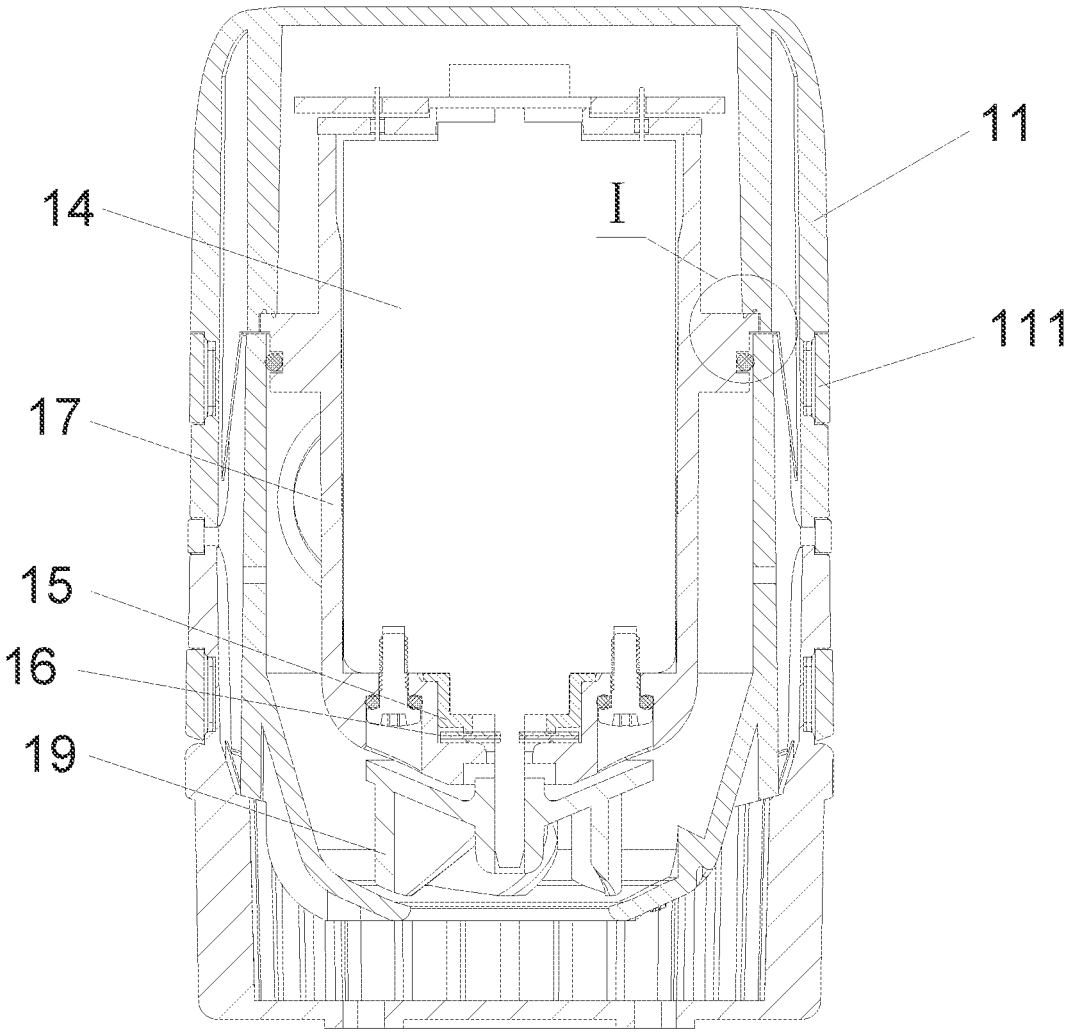
FIG. 5 is a cross-sectional view of Embodiment 1.
Figure 6:
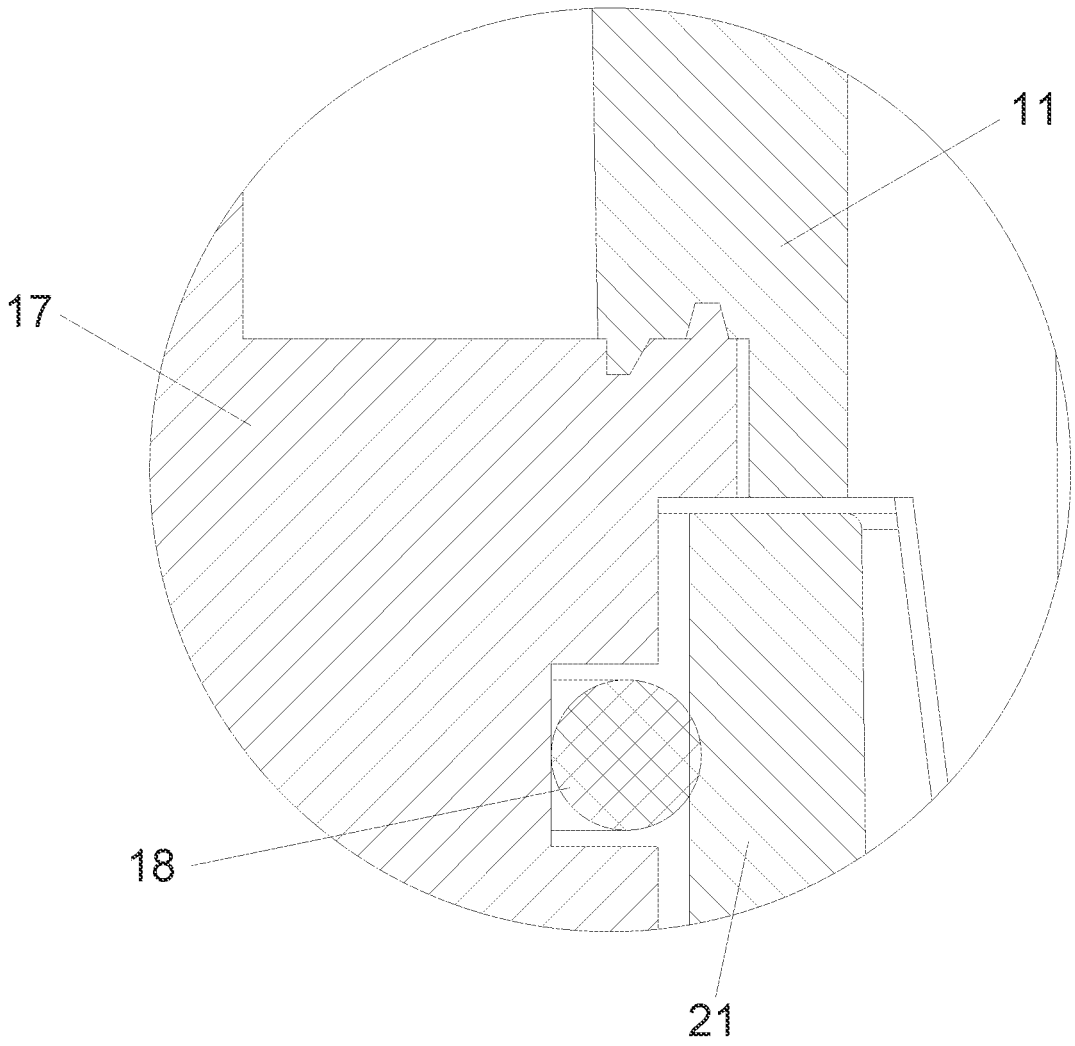
FIG. 6 is a partially enlarged view of the portion I encircled in FIG. 5.

As shown in FIG. 5 and FIG. 6, the sealing ring 18 is provided between the motor cover 17 and the housing 21. The upper cover 11 and the motor cover 17 are welded in a double ultrasonic wire structure. The oil seal seat 15 is sleeved on the output shaft of the motor 14. A plurality of oil seals 16 are arranged between the oil seal seat 15 and the motor cover 17 to seal the entire motor assembly, which provides waterproof and sealing protection for the electrical components and improves the waterproof and sealing performance.

When pumping water, the submersible pump can be directly placed in the water, or connected through a pipeline, which is described by the following embodiments.

Embodiment 1

As shown in FIGS. 1-4, the bottom of the housing 21 is connected to the filter cover 4 through another two clamping holes 26, wherein the filter cover 4 is provided with two elastic buckles. In use, the submersible pump is directly placed into the water. After use, the buckle 111 is pressed to separate the motor module 1, the pump chamber module 2, and the filter cover 4, which is convenient for cleaning the pump chamber module 2 and the filter cover 4.

In the present embodiment, the motor module 1 is provided with the PCB 12. The PCB 12 is fixed on the end surface of the motor 14 through the PCB bracket 13. The PCB is configured to disconnect the power supply of the motor 14 when overloaded to prevent burnout.

Specifically, the submersible pump in the present embodiment can adopt an automatic control mode. When the current ranges from 1.25 A to 8 A, the submersible pump is activated to pump the water. When the current is less than 1.25 A (no water) or greater than 8 A (locked-rotor), the submersible pump is stopped and then tries to start again 2.5 minutes after being stopped.

Embodiment 2

As shown in FIGS. 7-12, the bottom of the pump chamber module 2 is rotatably connected to the three-way pipe 5. Specifically, the bottom of the housing 21 is provided with a plurality of clamping blocks 27 distributed annularly. The inner side of the top of the three-way pipe 5 is provided with limiting blocks 51 distributed annularly. The plurality of blocking blocks 27 are in an interference fit with the limiting blocks 51. In this state, the three-way pipe 5 and the pump chamber module 2 can rotate 360° relative to each other to adapt to various operating environments.

The shape of the three-way pipe 5 is illustrated by the following three embodiments.

Embodiment 2.1

Figure 7:
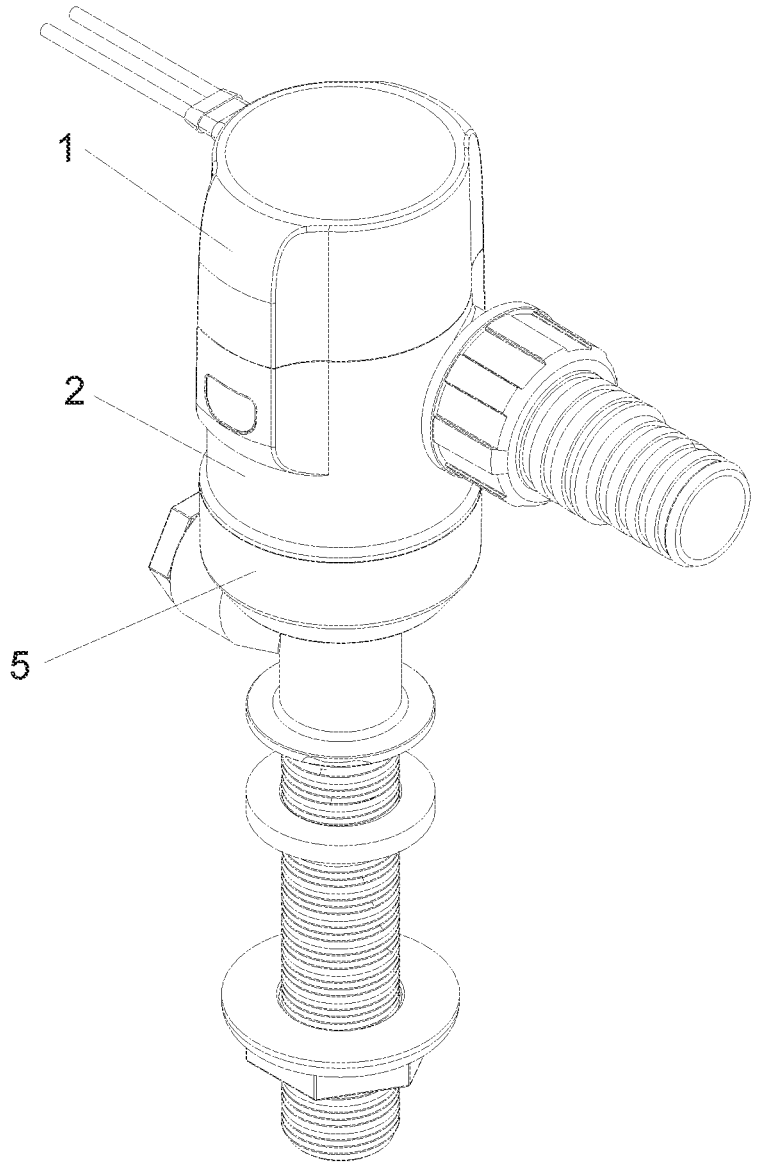
FIG. 7 is a schematic diagram showing the external structure of Embodiment 2.1.
Figure 8:
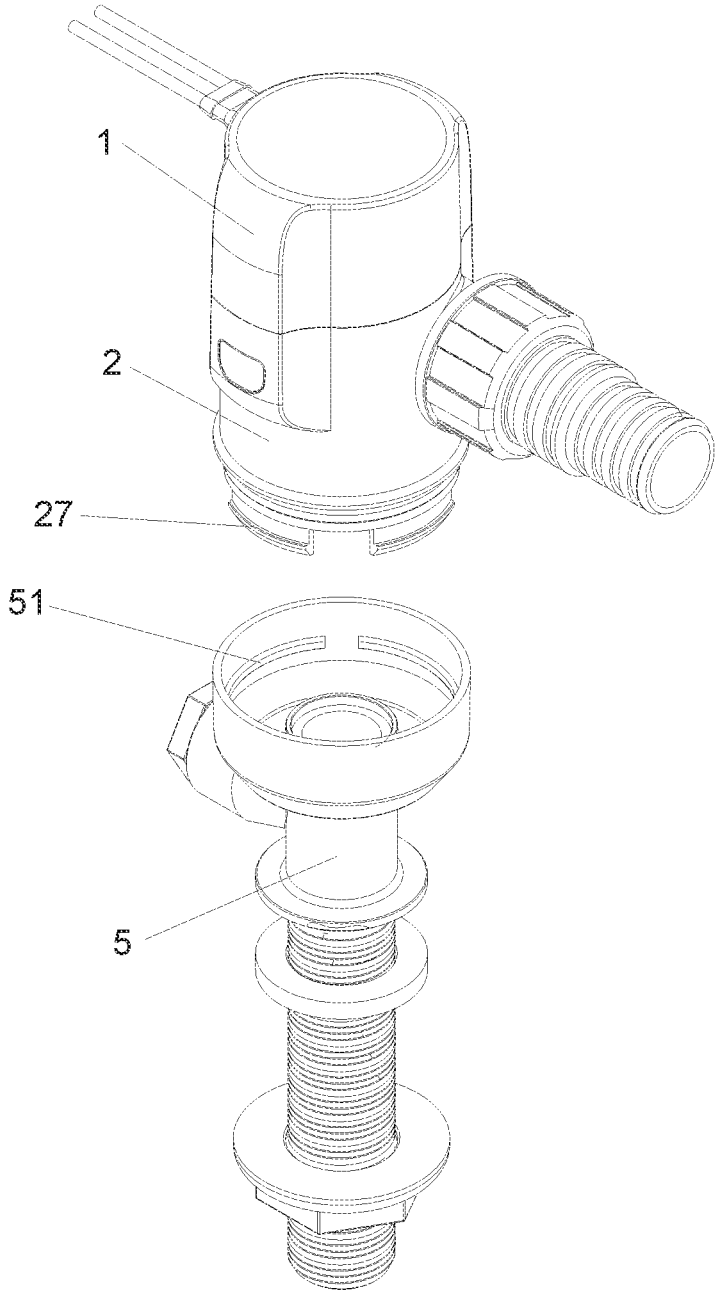
FIG. 8 is a schematic diagram showing a disassembled state of the modules of Embodiment 2.1.

As shown in FIG. 7 and FIG. 8, the three-way pipe 5 is substantially a straight pipe with a branch pipe on one side. The straight pipe section is relatively long and can pass through the partition and be fixed by a lock nut to directly pump in the water outside the partition.

Embodiment 2.2

Figure 9:
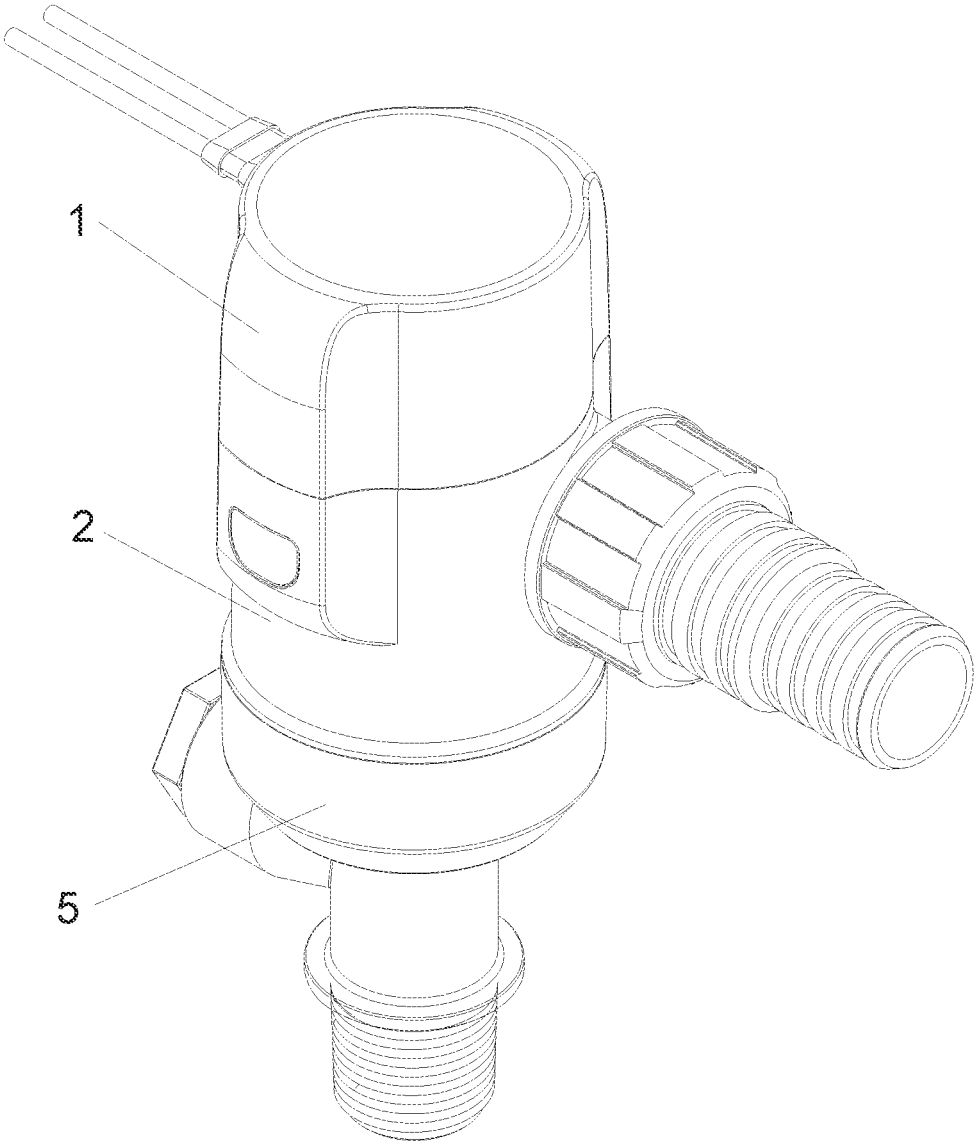
FIG. 9 is a schematic diagram showing the external structure of Embodiment 2.2.
Figure 10:
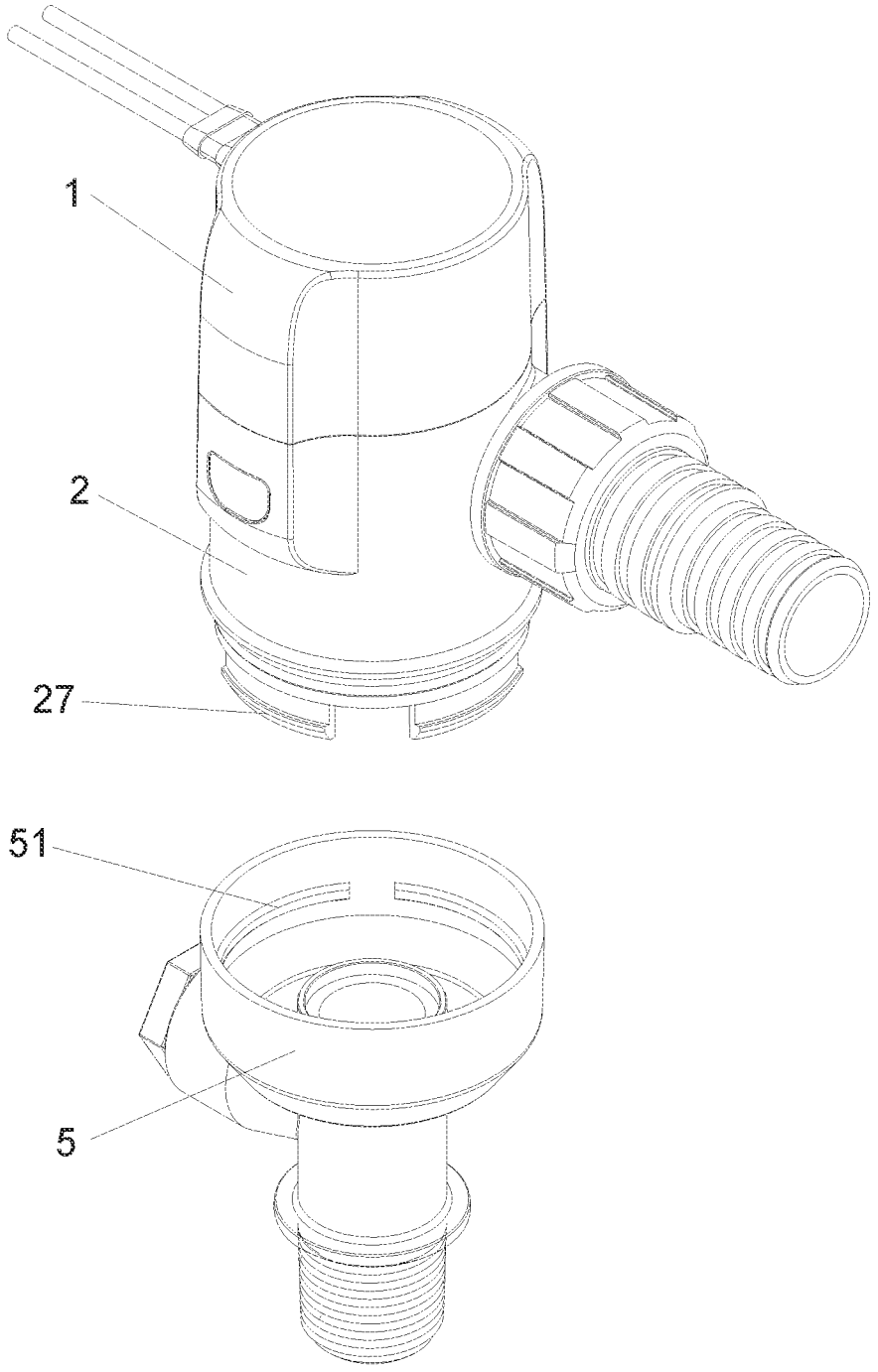
FIG. 10 is a schematic diagram showing a disassembled state of the modules of Embodiment 2.2.

As shown in FIG. 9 and FIG. 10, the three-way pipe 5 is substantially a straight pipe with a branch pipe on one side. The straight pipe section is relatively short and can be directly connected to a drain valve, so that the water pump is vertically fixed on the bottom plate and can pressurize the circulating water circuit.

Embodiment 2.3

Figure 11:
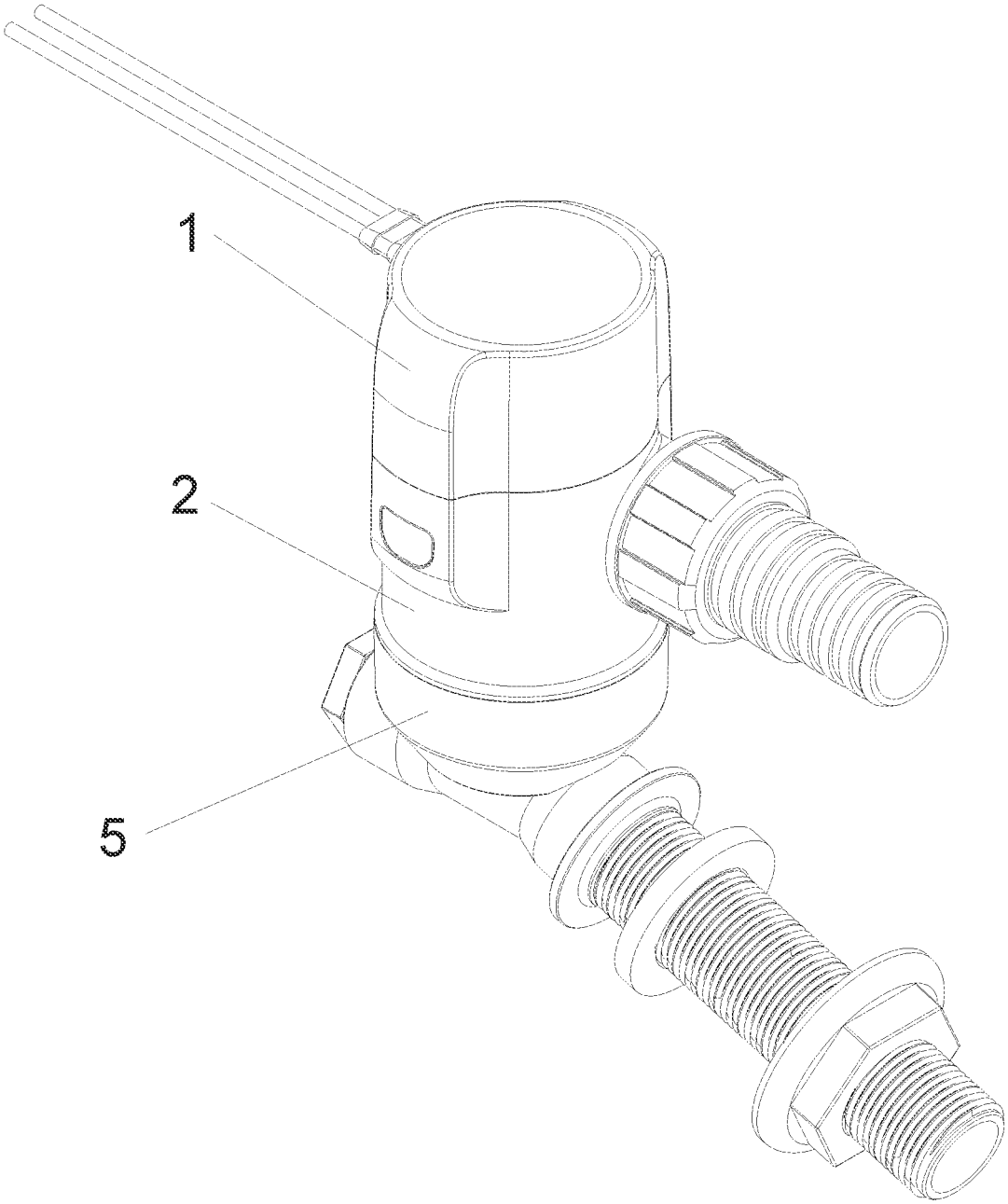
FIG. 11 is a schematic diagram showing the external structure of Embodiment 2.3.
Figure 12:
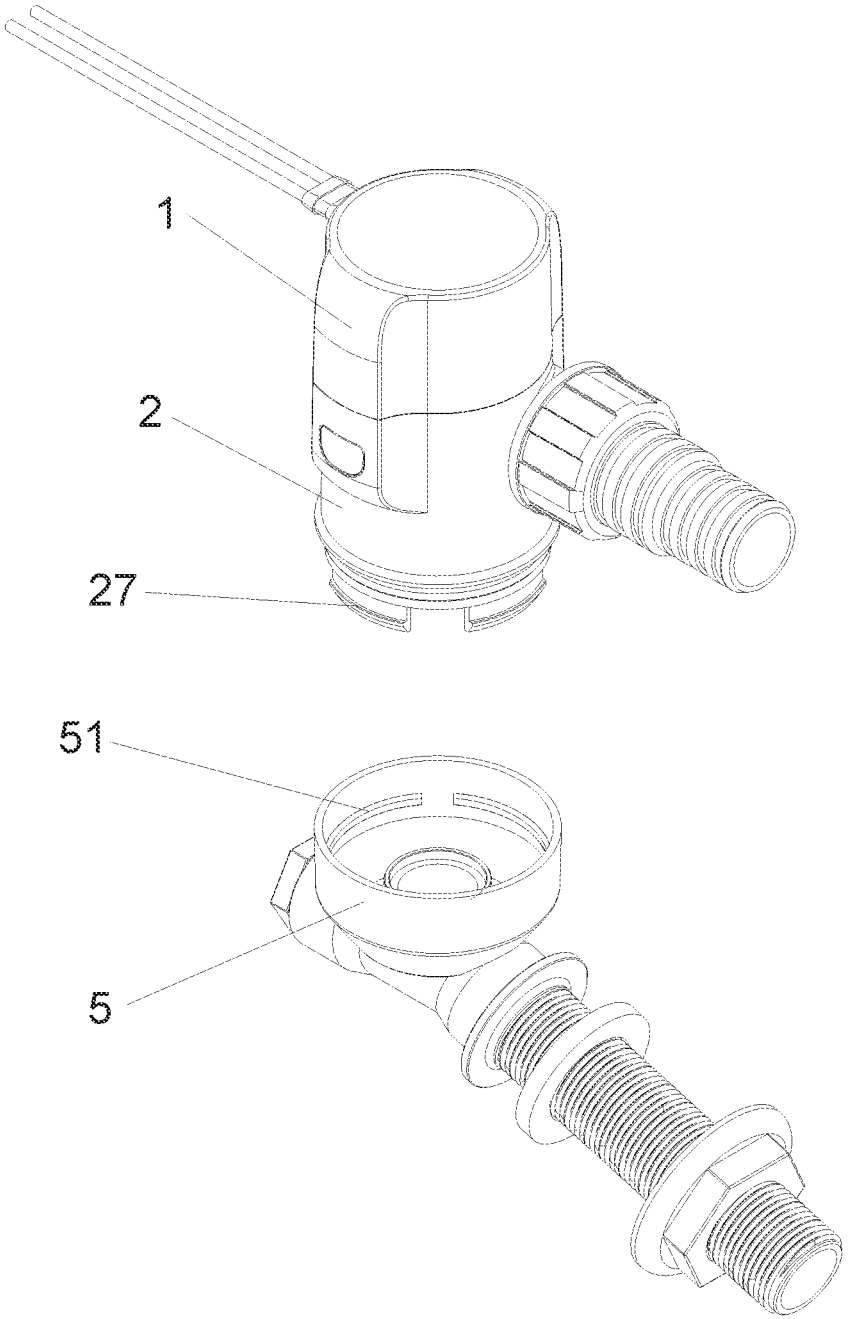
FIG. 12 is a schematic diagram showing a disassembled state of the modules of Embodiment 2.3.

As shown in FIG. 11 and FIG. 12, the three-way pipe 5 is an inclined pipe. The axis of the inclined pipe and the axis of the branch pipe intersect at the pump body. The inclined pipe can be passed through the inclined partition and fixed by a lock nut to ensure the verticality of the pump body and directly pump in the water outside the partition.

The design point of the present invention is to modularize the submersible pump and separate the circuit module from the water passage, and the modules are detachably connected to facilitate disassembly, cleaning and replacement of accessories, which is more convenient to use with the aid of the quick connector.

The above description is only the preferred embodiments of the present invention and should not be construed as any limitation to the technical scope of the present invention. Therefore, any minor modifications, equivalent changes, and improvements made to the foregoing embodiments based on the technical essence of the present invention shall fall within the scope of the technical solution of the present invention.

What is claimed is:

1. A detachable submersible pump with a modular design, comprising a motor module, and a pump chamber module;

wherein the motor module comprises an upper cover, a motor, a motor cover, and an impeller; the motor is placed inside the upper cover and the motor cover; an output shaft of the motor passes through the motor cover and is connected to the impeller;

the pump chamber module comprises a housing, a water outlet, a connecting pipe, and a lock nut; the water outlet is arranged on one side of the housing; the lock nut is sleeved on the connecting pipe and is connected to the water outlet by threads; and the pump chamber module has a pair of outwardly extending clamping hole structures formed on opposite sides of a wall of the pump chamber module, each clamping hole structure comprises a channel body with a planer surface having opposing side walls, a first clamping hole is formed in the planer surface, and the opposing side walls connect the planer surface, respectively, and the wall of the pump chamber module, each of two sides of the upper cover is provided with a resilient elastic buckle with an enlarged head; the first clamping hole receives the enlarged head of the resilient elastic buckle to removably secure the motor module to the pump chamber module, and the impeller is placed inside the housing.

2. The detachable submersible pump according to claim 1, wherein, a second clamping hole is formed in the planer surface of each of the clamping hole structures, and each of two sides of a filter cover is provided with a resilient elastic buckle with an enlarged head; the second clamping hole receives, respectively, the enlarged head of the resilient elastic buckle on the filter cover to removably secure the filter cover to the pump chamber module.

3. The detachable submersible pump according to claim 1, wherein an oil seal seat is sleeved on the output shaft of the motor, and a plurality of oil seals are provided between the oil seal seat and the motor cover.

4. The detachable submersible pump according to claim 1, wherein the upper cover and the motor cover are welded by ultrasonic welding.

5. The detachable submersible pump according to claim 1, wherein a check valve is provided inside the connecting pipe.

6. The detachable submersible pump according to claim 1, wherein a PCB is provided inside the motor module.

7. The detachable submersible pump according to claim 6, wherein the PCB is fixed on an end surface of the motor through a PCB bracket.

8. The detachable submersible pump according to claim 1, wherein a bottom of the pump chamber module is rotatably connected to a three-way pipe.

9. The detachable submersible pump according to claim 8, wherein a bottom of the housing is provided with a plurality of clamping blocks, wherein the plurality of clamping blocks are distributed annularly;

an inner side of a top of the three-way pipe is provided with a plurality of limiting blocks, wherein the plurality of limiting blocks are distributed annularly; and the plurality of clamping blocks are in an interference fit with the plurality of limiting blocks; and the housing and the three-way pipe rotate 360° relative to each other.

* * * * *